US012601242B1

(12) United States Patent
Bi et al.

(10) Patent No.: US 12,601,242 B1
(45) Date of Patent: Apr. 14, 2026

(54) CONTROLLED SHOCKWAVE-BASED STIMULATION METHOD FOR COALBED METHANE (CBM) HORIZONTAL WELL

(71) Applicants: HUAINAN MINING (GROUP) CO., LTD, Huainan (CN); PING'AN COAL MINE GAS CONTROL NATIONAL ENGINEERING RESEARCH CENTER CO., LTD, Huainan (CN); PING AN COAL MINING ENGINEERING TECHNOLOGY RESEARCH INSTITUTE CO., LTD, Huainan (CN); XI'AN JIAOTONG UNIVERSITY, Xi'an (CN)

(72) Inventors: Bo Bi, Huainan (CN); Anxiang Feng, Huainan (CN); Xiaozhang Tong, Huainan (CN); Youzhi Zhao, Huainan (CN); Wei Yang, Huainan (CN); Shougang Ding, Huainan (CN); Benliang Chen, Huainan (CN); Tao Zhou, Huainan (CN); Yang Yang, Huainan (CN); Chunhui Ye, Huainan (CN); Shuo Zhang, Huainan (CN); Shouxiang Feng, Huainan (CN)

(73) Assignees: HUAINAN MINING (GROUP) CO., LTD, Huainan (CN); PING'AN COAL MINE GAS CONTROL NATIONAL ENGINEERING RESEARCH CENTER CO., LTD, Huainan (CN); PING AN COAL MINING ENGINEERING TECHNOLOGY RESEARCH INSTITUTE CO., LTD, Huainan (CN); XI'AN JIAOTONG UNIVERSITY, Xi'an (CN)

( * ) Notice: Subject to any disclaimer, the term of this patent is extended or adjusted under 35 U.S.C. 154(b) by 0 days.

(21) Appl. No.: 19/344,878

(22) Filed: Sep. 30, 2025

Related U.S. Application Data

(63) Continuation of application No. PCT/CN2025/076582, filed on Feb. 10, 2025.

(30) Foreign Application Priority Data

Oct. 11, 2024 (CN) ..... 202411416702.8

(51) Int. Cl.
*E21B 43/00* (2006.01)
*E21B 7/04* (2006.01)
*E21B 43/26* (2006.01)

(52) U.S. Cl.
CPC ..... *E21B 43/006* (2013.01); *E21B 7/046* (2013.01); *E21B 43/26* (2013.01)

(58) Field of Classification Search
CPC ..... E21B 41/00
See application file for complete search history.

(56) References Cited

U.S. PATENT DOCUMENTS

2011/0259593 A1 10/2011 Kostrov et al.
2022/0074286 A1* 3/2022 Lonnes ..... E21B 17/08

FOREIGN PATENT DOCUMENTS

CN 103195468 A 7/2013
CN 107956505 A 4/2018
(Continued)

*Primary Examiner* — William D Hutton, Jr.
*Assistant Examiner* — Avi T Skaist
(74) *Attorney, Agent, or Firm* — Bayramoglu Law Offices LLC

(57) ABSTRACT

A controlled shockwave-based stimulation method for a coalbed methane (CBM) horizontal well includes: S1: selecting a group of upward directional drilling sites in an underground roadway of a service mine for a horizontal well, where directional drilling target locations are coalbeds respectively directly opposite to horizontal well perforation points and at multiple distances from the horizontal well; S2:
(Continued)

drilling for an A m target location, and determining whether the target location is within a fracturing affected zone and a drainage affected zone of the horizontal well; conducting a controlled shockwave operation if the drilling target location is within the fracturing affected zone; and S3: drilling at each of the horizontal well perforations according to the step S2 and performing a determination until target locations within the fracturing affected zone are found for all the horizontal well perforations; and conducting a controlled shockwave operation.

13 Claims, 2 Drawing Sheets

(56) References Cited

FOREIGN PATENT DOCUMENTS

| | | | |
|---|---|---|---|
| CN | 110617103 | A | 12/2019 |
| CN | 115749691 | A | 3/2023 |
| RU | 2540709 | C1 | 2/2015 |

* cited by examiner

CONTROLLED SHOCKWAVE-BASED STIMULATION METHOD FOR COALBED METHANE (CBM) HORIZONTAL WELL

CROSS REFERENCE TO THE RELATED APPLICATIONS

This application is the continuation application of International Application No. PCT/CN2025/076582, filed on Feb. 10, 2025, which is based upon and claims priority to Chinese Patent Application No. 202411416702.8, filed on Oct. 11, 2024, the entire contents of which are incorporated herein by reference.

TECHNICAL FIELD

The present disclosure relates to the field of energy exploitation, and in particular to a stimulation method for a coalbed methane (CBM) horizontal well.

BACKGROUND

Coalbed methane (CBM) (gas) disasters pose a significant threat to coal mine safety production in China. As coal mining depths increase, CBM (gas) disasters become particularly severe. CBM is also a major contributor to the greenhouse effect, with its greenhouse effect being more than twenty times that of an equivalent volume of carbon dioxide. Through drainage methods, extracting each additional cubic meter of CBM is equivalent to reducing over twenty cubic meters of carbon dioxide emissions.

Currently, under the conditions of abundant coal, scarce oil, and limited natural gas, CBM is an associated resource extracted alongside coal. Enhancing CBM development contributes to energy security. However, coalbeds generally suffer from complex geological structures and low permeability. Despite decades of sustained efforts, CBM production consistently falls below expectations. In soft and low-permeability CBM wells, factors such as formation confining pressure and in-situ gas pressure cause fractures generated by fracturing to collapse rapidly. This leads to swift production decline and low yields. In the prior art, Chinese patent application CN107956505A disposes a controlled shockwave-based permeability enhancement method for an underground coal mine borehole. However, this method applies shocks without prior formation evaluation, resulting in ineffective fracturing and persistently low production.

Information disclosed in this background section is provided merely for increasing the comprehension of the general background of the present disclosure, and shall not be regarded as acknowledgment or any form of suggestion that the information constitutes the prior art commonly known to those of ordinary skill in the art.

SUMMARY

A technical problem to be solved by the present disclosure is that current coalbed methane (CBM) extraction features swift production decline and low yields.

The present disclosure solves the above technical problem through the following technical solution:

A controlled shockwave-based stimulation method for a CBM horizontal well, where a horizontal section of a surface well includes N horizontal well perforations, N being an integer greater than 1; and the stimulation method includes following steps:

S1: selecting a group of upward directional drilling sites in an underground roadway of a service mine for a horizontal well, where directional drilling target locations are coalbeds respectively directly opposite to the horizontal well perforation points and at distances of A m, A-B m, A-2B m, A-3B m, and A-4B m from the horizontal well;

S2: drilling for the A m target location; determining whether the target location is within a fracturing affected zone during the construction process; and determining, after the drilling enters the coalbed, whether the target location is within a drainage affected zone of the horizontal well;

conducting a controlled shockwave operation if the drilling target location is within the fracturing affected zone;

drilling, if the drilling target location is not within the fracturing affected zone, for the A-B m or A-2B m or A-3B m or A-4B m target location until a target location within the fracturing affected zone is found; and S3: drilling at each of the horizontal well perforations according to the step S2 and performing a determination until target locations within the fracturing affected zone are found for all the horizontal well perforations; and conducting a controlled shockwave operation.

Preferably, in the step S2, the drilling for the Am target location includes: performing a trip-out operation after the drilling reaches a depth of 15-30 m; installing a casing and a wellhead sealing gate valve; injecting cement slurry into a borehole for sealing; and drilling after the cement slurry sets: starting the drilling at a location with a 1.5-2.5 m normal distance to a coalbed floor, and ending the drilling at a location with a 1.5-2.5 m normal distance to a coalbed roof after the drilling penetrates the coalbed.

Preferably, the stimulation method includes: conducting, during the drilling, laboratory analysis on a water sample and a drill cutting generated by the drilling; determining whether the target location is within the fracturing affected zone; determining that, if there is a fracturing fluid present in the water sample or a fracturing sand present in the drill cutting, the target location is within the fracturing affected zone; and determining that, if there is no fracturing fluid present in the water sample or no fracturing sand present in the drill cutting, the target location is not within the fracturing affected zone.

Preferably, the stimulation method includes: conducting sealed sampling at a fixed point after the drilling enters the coalbed; measuring a gas content in a coal sample; and determining whether the target location is within the drainage affected zone of the horizontal well: comparing the gas content in the coal sample with an original gas content of the coalbed; determining that, if the gas content in the coal sample decreases, the target location is within the drainage affected zone of the horizontal well; and determining that, if the gas content in the coal sample shows no change, the target location is not within the drainage affected zone of the horizontal well.

Preferably, the stimulation method includes: first drilling for the A m target location in terms of drilling sequence; and conducting a controlled shockwave operation if the target location is within the fracturing affected zone;

determining that, if the A m target location is not within the fracturing affected zone, there are two situations as follows:

in a first situation when the target location is not within the drainage affected zone: redesigning the drilling to take the A-2B m coalbed as the drilling target location; and in a second situation when the target location is within the drainage affected zone but not within the fracturing affected zone: redesigning the drilling to take the A-B m coalbed as the drilling target location.

Preferably, the stimulation method includes: conducting, after drilling for the A-2B m target location, a controlled shockwave operation if the target location is within the fracturing affected zone;

determining that, if the target location is not within the fracturing affected zone, there are two situations as follows:

when the target location is not within the drainage affected zone: redesigning the drilling to take the A-4B m coalbed as the drilling target location; and when the target location is within the drainage affected zone but not within the fracturing affected zone: redesigning the drilling to take the A-3B m coalbed as the drilling target location; and sealing an original borehole for pressure measurement.

Preferably, the stimulation method includes: conducting, after drilling for the A-B m target location, a controlled shockwave operation if the target location is within the fracturing affected zone;

determining that, if the target location is not within the fracturing affected zone, there are two situations as follows:

in a first situation when the target location is not within the drainage affected zone: redesigning the drilling to take the A-3B m coalbed as the drilling target location; and when the target location is within the drainage affected zone but not within the fracturing affected zone: redesigning the drilling to take the A-2B m coalbed as the drilling target location; and sealing an original borehole for pressure measurement; and continuing to drill for the A-3B m and A-4B m target locations until a target location within the fracturing affected zone is found.

Preferably, the controlled shockwave operation is conducted as follows: delivering, after the drilling, a controlled shockwave generation device through a drilling rig to a stratum where a fracturing sand or fracturing fluid is detected; closing a borehole sealing device, and injecting water into the borehole through a reserved pipe; and conducting a shock operation when the controlled shockwave generation device detects a water pressure reaching a set value.

Preferably, the stimulation method includes: evaluating, when the controlled shockwave operation corresponding to a horizontal well perforation is completed, a change in a drainage parameter before and after a shock;

determining that, if an instantaneous gas production rate and a casing pressure increase, a shock wave is effective, and applying a shock wave intensity of W for the controlled shockwave operation at a next horizontal well perforation point;

determining that, if the casing pressure decreases, the shock wave intensity is too high, and applying a shock wave intensity of 0.8 W for the controlled shockwave operation at the next horizontal well perforation point; and applying, if the instantaneous gas production rate and the casing pressure show no change, a shock wave intensity of 1.2 W for the controlled shockwave operation at the next horizontal well perforation point.

The present disclosure promptly adjusts the shock intensity based on feedback to ensure the shock effect.

Preferably, the stimulation method includes: before conducting the controlled shockwave operation, notifying a surface well drainage constructor to continuously monitor the drainage parameter including flowing bottomhole pressure, casing pressure, and instantaneous gas production rate; and notifying an underground constructor in case of any abnormality.

The present disclosure has following advantages:

The technical solution of the present disclosure is constructed in underground coal mines without disrupting drainage of the surface CBM well. By drilling directional boreholes into the fracturing affected zone, the controlled shockwave device is used to stimulate fractures created by surface well fracturing. The shock waves propagate through the fracturing fluid within the fractures to alter coalbed pressure distribution and break barriers between fractures, thereby increasing the production of the CBM well.

The present disclosure determines whether the construction location is within the fracturing affected zone and the drainage affected zone, and adjusts the target location for the next borehole, avoiding blind construction and improving drilling efficiency.

The present disclosure promptly adjusts the shock intensity based on feedback to ensure the shock effect.

REFERENCE NUMERALS

1. horizontal section of surface well; 2. horizontal well perforation; 3. coalbeds at different distances from horizontal well; 4. fracturing affected zone evaluation borehole; 5. controlled shockwave operation borehole; 6. borehole coring section; and 7. 2 m normal distance lines from coalbed roof and floor.

DETAILED DESCRIPTION OF THE EMBODIMENTS

In order to make the objectives, technical solutions, and advantages of embodiments of the present disclosure clearer, the following clearly and completely describes the technical solutions in the embodiments of the present disclosure with reference to the embodiments of the present disclosure. Apparently, the described embodiments are some rather than all of the embodiments. All other embodiments obtained by a person of ordinary skill in the art based on the embodiments of the present disclosure without creative efforts shall fall within the protection scope of the present disclosure.

Figure 1:
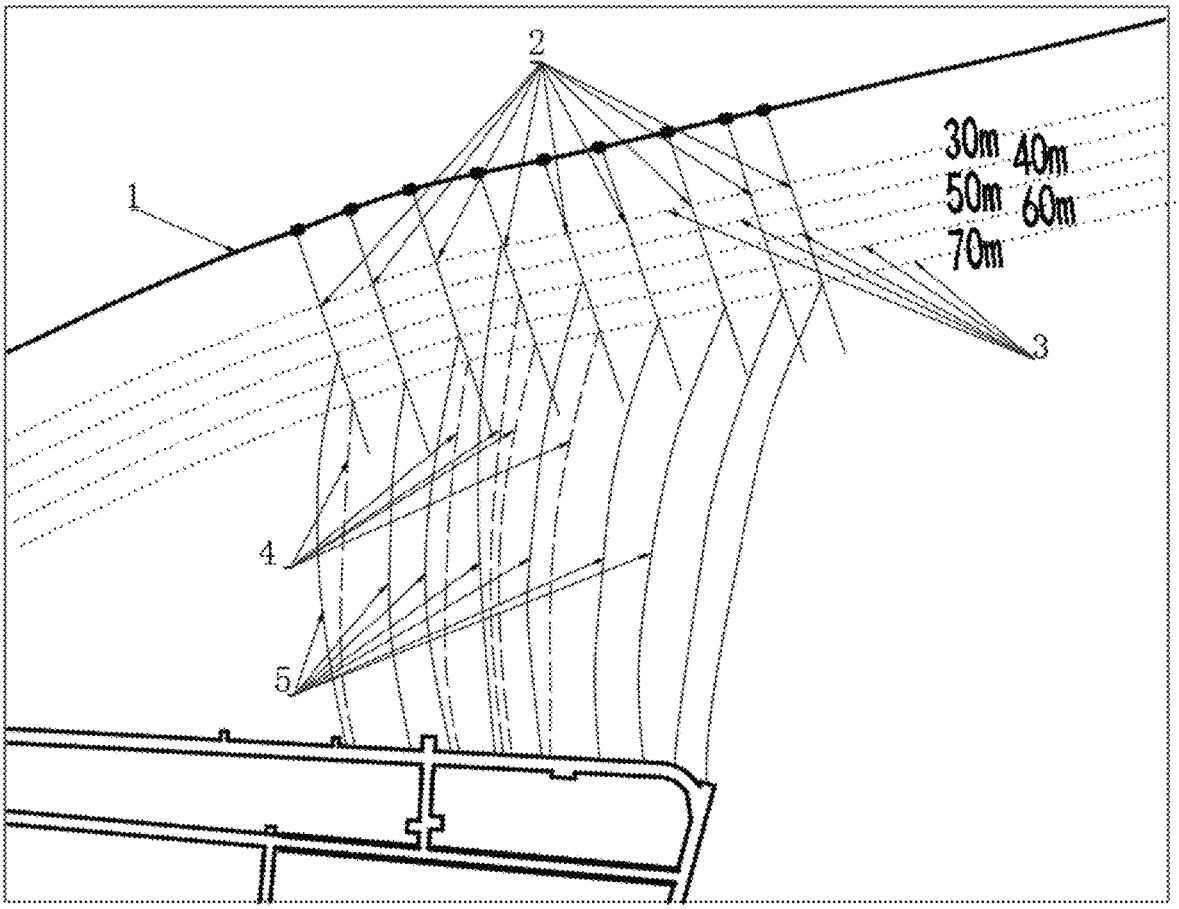
FIG. 1 is a structural schematic diagram of a controlled shockwave-based stimulation method for a CBM horizontal well according to an embodiment of the present disclosure.

As shown in FIG. 1, horizontal section 1 of a surface well includes nine horizontal well perforations 2. Fracturing is performed at the horizontal well perforations 2. The fracturing is designed to fracture an underground rock formation and enhance its permeability using a high-pressure water flow, thereby increasing the permeability and mobility of oil and gas. Fracturing sand is injected into the horizontal well perforations. After the fracturing is completed, gas accumulates within the horizontal well perforations 2, and CBM is drained. Verification and evaluation are required to determine locations where the gas can be extracted to the horizontal section 1 of the surface well. Therefore, this embodiment first involves evaluating a fracturing affected zone and a drainage affected zone of the horizontal well. The fracturing affected zone refers to a range of the fracturing sand and a fracturing fluid. A location where the fracturing sand or the fracturing water appears is considered falling within the fracturing affected zone. The drainage affected zone involves the determination of whether the gas decreases. A location where the gas decreases is considered falling within the drainage affected zone. The horizontal well drainage affected zone is larger than the fracturing affected zone. A controlled shockwave construction can be conducted at a location falling within the fracturing affected zone to achieve increase production.

Specifically, the controlled shockwave-based stimulation method for a CBM horizontal well includes following steps.

S1. An underground roadway of a service mine for a horizontal well serves as a construction point for upward directional drilling. Target locations of directional boreholes are coalbed locations directly opposite to horizontal well perforations (black dots in FIG. 1) and at distances of A m, A-B m, A-2B m, A-3B m, and A-4B m from the horizontal well, respectively. In this embodiment, the target locations of the directional boreholes are coalbed locations directly opposite to the horizontal well perforations and at distances of 70 m, 60 m, 50 m, 40 m, and 30 m respectively from the horizontal well (hereinafter referred to as a 70 m target location, a 60 m target location, a 50 m target location, a 40 m target location, and a 30 m target location, respectively).

Furthermore, the values of A and B are selected based on actual conditions such as coalbed thickness. This embodiment does not limit the number of target locations. That is, the target locations can also extend to A-5B m, A-6B m, etc.

A can be 50-200 m, and B can be 2-20 m.

S2. First, construction is conducted for the 70 m target location. The borehole constructed in the first operation is called fracturing affected zone evaluation borehole 4. The purpose is to determine whether the location is within the fracturing affected zone. However, the fracturing affected zone evaluation borehole 4 may ultimately coincide with controlled shockwave operation borehole 5. If they do not coincide, re-drilling is required. Therefore, the fracturing affected zone evaluation borehole 4 may ultimately not be the controlled shockwave operation borehole 5.

Figure 2:
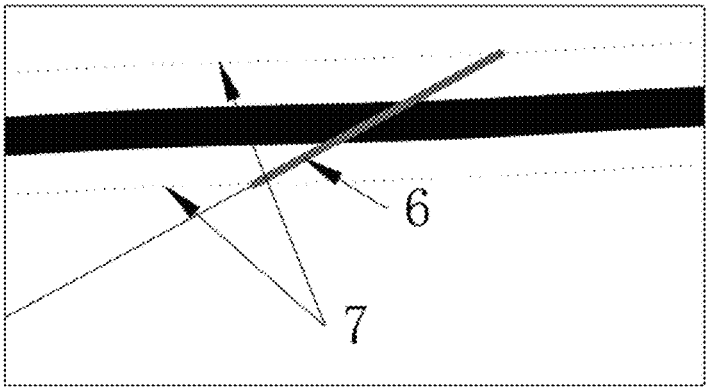
FIG. 2 is a schematic diagram of construction during a drilling process according to an embodiment of the present disclosure.
Figure 3:
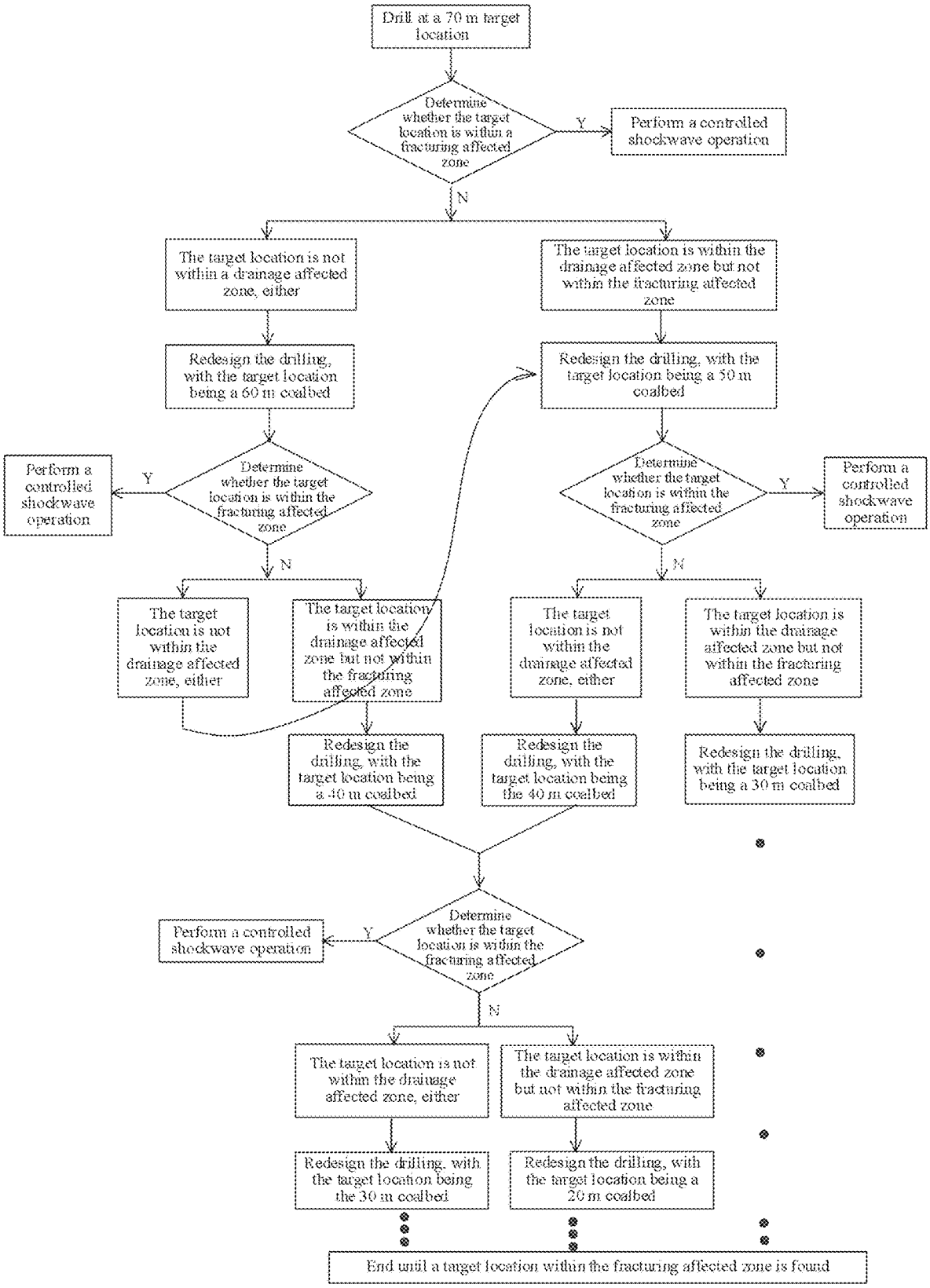
FIG. 3 is a flowchart of the controlled shockwave-based stimulation method for a CBM horizontal well according to an embodiment of the present disclosure.

As shown in FIG. 2, during the drilling process, after the drilling reaches a depth of 20 m, a trip-out operation is performed. A casing and a wellhead sealing gate valve are installed. Cement slurry is injected into the borehole to seal the borehole. After the cement sets, drilling resumes. The drilling starts at a location of a 2 m normal distance from a coalbed floor, and ends at a location of a 2 m normal distance from a coalbed roof after penetrating the coalbed.

During construction, a water sample and a drill cutting generated by drilling are subjected to a laboratory analysis. It is determined whether there is a fracturing fluid in the water through a comparative analysis by measuring a potassium ion (K) concentration in the water sample (or aided by other indicators). By analyzing a moisture content of the drill cutting and determining whether there is fracturing sand in the drill cutting (through a spectral analysis of a suspected sample to determine composition), it is determined whether the corresponding location is within the fracturing affected zone.

Meanwhile, after the borehole enters the coalbed, sealed sampling is conducted at a fixed point. A gas content in a coal sample is measured (compared and analyzed against an original coalbed gas content) to determine whether the corresponding location is within the drainage affected zone of the horizontal well. Determining whether the corresponding location is within the fracturing affected zone and determining within the drainage affected zone are performed concurrently during drilling.

During the drilling process, the drilling stops immediately if a significant increase in water inflow is detected, and the gate valve is closed to seal the wellhead if necessary.

As mentioned above, drilling is first conducted for the 70 m target location. If it is determined that the location falls within the fracturing affected zone through the presence of the fracturing fluid or fracturing water, a controlled shockwave construction is conducted.

The controlled shockwave construction is conducted as follows. After drilling, a controlled shockwave generation device is delivered by a drilling rig to a stratum where the fracturing sand or the fracturing fluid is detected. A borehole sealing device is closed. Water is injected into the borehole through a reserved pipe. When the controlled shockwave generation device detects that a water pressure reaches a set value, the shock operation is commenced.

If the borehole at the 70 m target location does not enter the fracturing affected zone, the following two situations exist.

In a first situation, if the location is not within the drainage affected zone, it indicates that the fracturing of the horizontal well perforation has no effect on the coalbed gas, and the location is far from the fracturing affected zone. In this situation, the drilling is redesigned, and the coalbed at the farther 50 m target location is selected as the target drilling location (proceed to S21).

In a second situation, if the location is within the drainage affected zone, it indicates that the fracturing of the horizontal well perforation has an effect on the coalbed gas, but the location is not far from the fracture range. In this situation, the drilling is redesigned, and the coalbed at the closer 60 m target location is selected as the target drilling location.

Since the borehole at the 70 m target location no longer has use value, the borehole at the 70 m target location is sealed, and pressure measurement is conducted.

S21. After drilling is conducted for the 50 m target location, if the location is within the fracturing affected zone, a controlled shockwave construction is conducted. If the location is outside the fracturing affected zone, the following two situations exist. If the location is not within the drainage affected zone, the drilling is redesigned, and the coalbed at the 30 m location is selected as the target drilling location (proceed to S24). If the location is within the drainage affected zone but outside the fracturing affected zone, the drilling is redesigned, and the coalbed at the 40 m location is selected as the target drilling location (proceed to S23). The originally constructed borehole is sealed, and pressure measurement is conducted.

S22. After drilling is conducted for the 60 m target location, if the location is within the fracturing affected zone, a controlled shockwave construction is conducted. If the location is outside the fracturing affected zone, the following two situations exist. If the location is not within the drainage affected zone, the drilling is redesigned, and the coalbed at the 40 m location is selected as the target drilling location.

If the location is within the drainage affected zone but outside the fracturing affected zone, the drilling is redesigned, and the coalbed at the 50 m location is selected as the target drilling location. The originally constructed borehole is sealed, and pressure measurement is conducted.

The subsequent steps follow the same procedure.

S23. After drilling is conducted at the 40 m target location, if the location is within the fracturing affected zone, a controlled shockwave construction is conducted. If the location is outside the fracturing affected zone, the following two situations exist. If the location is not within the drainage affected zone, the drilling is redesigned, and the coalbed at the 20 m location is selected as the target drilling location. If the location is within the drainage affected zone but outside the fracturing affected zone, the drilling is redesigned, and the coalbed at the 30 m location is selected as the target drilling location. The originally constructed borehole is sealed, and pressure measurement is conducted.

S24. After drilling is conducted at the 30 m target location, if the location is within the fracturing affected zone, a controlled shockwave construction is conducted. If the location is not within the fracturing affected zone, the borehole is sealed, and pressure measurement is conducted.

S3. Based on the step S2, drilling constructions are conducted through each horizontal well perforation until target locations within the fracturing affected zone for all horizontal well perforations are found, and controlled shockwave constructions are conducted.

After the controlled shockwave construction for a horizontal well perforation is completed, changes in drainage parameters before and after the shock are determined. If the instantaneous gas production rate and casing pressure increase, it indicates the shock wave is effective, and the controlled shockwave construction for the next horizontal well perforation continues using a shock wave intensity of W. If the casing pressure decreases, it indicates the shock wave intensity is too high, and the controlled shockwave construction for the next horizontal well perforation uses a shock wave intensity of 0.8 W. If there is no change in the instantaneous gas production rate or casing pressure, the controlled shockwave construction for the next horizontal well perforation uses a shock wave intensity of 1.2 W.

Before the controlled shockwave construction is commenced, a surface well drainage constructor is notified to continuously monitor the drainage parameter such as flowing bottomhole pressure, casing pressure, and instantaneous gas production rate, and an underground constructor is notified in case of abnormalities.

This embodiment is constructed in underground coal mines without disrupting drainage of the surface CBM well. By drilling directional boreholes into the fracturing affected zone, the controlled shockwave device is used to stimulate fractures created by surface well fracturing. The shock waves propagate through the fracturing fluid within the fractures to alter coalbed pressure distribution and break barriers between fractures, thereby increasing the production of the CBM well.

The foregoing embodiments are only used to explain the technical solutions of the present disclosure, and are not intended to limit the same. Although the present disclosure is described in detail with reference to the foregoing embodiments, those of ordinary skill in the art should understand that they can still modify the technical solutions described in the foregoing embodiments, or perform equivalent substitutions on some technical features therein. These modifications or substitutions do not make the essence of the corresponding technical solutions deviate from the spirit and scope of the technical solutions of the embodiments of the present disclosure.

The invention claimed is:

1. A controlled shockwave-based stimulation method for a coalbed methane (CBM) horizontal well, wherein a horizontal section of a surface well comprises horizontal well perforations, and the stimulation method comprises following steps:

S1: selecting a group of upward directional drilling sites in an underground roadway of a service mine for a horizontal well, wherein directional drilling target locations are coalbeds respectively directly opposite to horizontal well perforation points and at distances of A m, A-B m, A-2B m, A-3B m, and A-4B m from the horizontal well;

S2: drilling for an A m target location, determining whether the target location is within a fracturing affected zone during the drilling, and determining, after the drilling enters the coalbed, whether the target location is within a drainage affected zone of the horizontal well;

conducting a controlled shockwave operation when the drilling target location is within the fracturing affected zone; and drilling, when the drilling target location is not within the fracturing affected zone, for the A-B m or A-2B m or A-3B m or A-4B m target location until a target location within the fracturing affected zone is found; and S3: drilling at each of the horizontal well perforations according to the step S2 and performing a determination until target locations within the fracturing affected zone are found for all the horizontal well perforations, and conducting the controlled shockwave operation.

2. The controlled shockwave-based stimulation method for the CBM horizontal well according to claim 1, wherein in the step S2, the drilling for the A m target location comprises: performing a trip-out operation after the drilling reaches a depth of 15 m-30 m; installing a casing and a wellhead sealing gate valve; injecting cement slurry into a borehole for sealing; and drilling after the cement slurry sets: starting the drilling at a location with a 1.5 m-2.5 m normal distance to a coalbed floor, and ending the drilling at the location with the 1.5 m-2.5 m normal distance to a coalbed roof after the drilling penetrates the coalbed.

3. The controlled shockwave-based stimulation method for the CBM horizontal well according to claim 1, wherein the stimulation method comprises: conducting, during the drilling, laboratory analysis on a water sample and a drill cutting generated by the drilling; determining whether the target location is within the fracturing affected zone; determining that, when there is a fracturing fluid present in the water sample or a fracturing sand present in the drill cutting, the target location is within the fracturing affected zone; and determining that, when there is no fracturing fluid present in the water sample or no fracturing sand present in the drill cutting, the target location is not within the fracturing affected zone.

4. The controlled shockwave-based stimulation method for the CBM horizontal well according to claim 1, wherein the stimulation method comprises: conducting sealed sampling at a fixed point after the drilling enters the coalbed; measuring a gas content in a coal sample; and determining whether the target location is within the drainage affected zone of the horizontal well: comparing the gas content in the coal sample with an original gas content of the coalbed;

determining that, when the gas content in the coal sample decreases, the target location is within the drainage affected zone of the horizontal well; and determining that, when the gas content in the coal sample shows no change, the target location is not within the drainage affected zone of the horizontal well.

5. The controlled shockwave-based stimulation method for the CBM horizontal well according to claim 1, wherein the stimulation method comprises: first drilling for the A m target location in terms of drilling sequence; and conducting the controlled shockwave operation when the target location is within the fracturing affected zone;

determining that, when the A m target location is not within the fracturing affected zone, there are two situations as follows:

in a first situation when the target location is not within the drainage affected zone: redesigning the drilling to take the A-2B m coalbed as the drilling target location; and in a second situation when the target location is within the drainage affected zone but not within the fracturing affected zone: redesigning the drilling to take the A-B m coalbed as the drilling target location.

6. The controlled shockwave-based stimulation method for the CBM horizontal well according to claim 5, wherein the stimulation method comprises: conducting, after drilling for the A-2B m target location, the controlled shockwave operation when the target location is within the fracturing affected zone;

determining that, when the target location is not within the fracturing affected zone, there are two situations as follows:

when the target location is not within the drainage affected zone: redesigning the drilling to take the A-4B m coalbed as the drilling target location; and when the target location is within the drainage affected zone but not within the fracturing affected zone: redesigning the drilling to take the A-3B m coalbed as the drilling target location; and sealing an original borehole for pressure measurement.

7. The controlled shockwave-based stimulation method for the CBM horizontal well according to claim 5, wherein the stimulation method comprises:

conducting, after drilling for the A-B m target location, the controlled shockwave operation when the target location is within the fracturing affected zone;

determining that, when the target location is not within the fracturing affected zone, there are two situations as follows:

when the target location is not within the drainage affected zone: redesigning the drilling to take the A-3B m coalbed as the drilling target location; and when the target location is within the drainage affected zone but not within the fracturing affected zone: redesigning the drilling to take the A-2B m coalbed as the drilling target location; and sealing the original borehole for pressure measurement; and continuing to drill for the A-3B m and A-4B m target locations until a target location within the fracturing affected zone is found.

8. The controlled shockwave-based stimulation method for the CBM horizontal well according to claim 6, wherein the controlled shockwave operation is conducted as follows: delivering, after the drilling, a controlled shockwave generation device through a drilling rig to a stratum where a fracturing sand or fracturing fluid is detected; closing a borehole sealing device, and injecting water into the borehole through a reserved pipe; and conducting a shock operation when the controlled shockwave generation device detects a water pressure reaching a set value.

9. The controlled shockwave-based stimulation method for the CBM horizontal well according to claim 6, wherein the stimulation method comprises: evaluating, when the controlled shockwave operation corresponding to a horizontal well perforation is completed, a change in a drainage parameter before and after a shock;

determining that, when an instantaneous gas production rate and a casing pressure increase, a shock wave is effective, and applying a shock wave intensity of W for the controlled shockwave operation at a next horizontal well perforation point;

determining that, when the casing pressure decreases, the shock wave intensity is too high, and applying a shock wave intensity of 0.8 W for the controlled shockwave operation at the next horizontal well perforation point; and applying, when the instantaneous gas production rate and the casing pressure show no change, a shock wave intensity of 1.2 W for the controlled shockwave operation at the next horizontal well perforation point.

10. The controlled shockwave-based stimulation method for the CBM horizontal well according to claim 9, wherein the stimulation method comprises: before conducting the controlled shockwave operation, notifying a surface well drainage constructor to continuously monitor the drainage parameter comprising flowing bottomhole pressure, casing pressure, and instantaneous gas production rate; and notifying an underground constructor in case of any abnormality.

11. The controlled shockwave-based stimulation method for the CBM horizontal well according to claim 7, wherein the controlled shockwave operation is conducted as follows: delivering, after the drilling, a controlled shockwave generation device through a drilling rig to a stratum where a fracturing sand or fracturing fluid is detected; closing a borehole sealing device, and injecting water into the borehole through a reserved pipe; and conducting a shock operation when the controlled shockwave generation device detects a water pressure reaching a set value.

12. The controlled shockwave-based stimulation method for the CBM horizontal well according to claim 7, wherein the stimulation method comprises: evaluating, when the controlled shockwave operation corresponding to a horizontal well perforation is completed, a change in a drainage parameter before and after a shock;

determining that, when an instantaneous gas production rate and a casing pressure increase, a shock wave is effective, and applying a shock wave intensity of W for the controlled shockwave operation at a next horizontal well perforation point;

determining that, when the casing pressure decreases, the shock wave intensity is too high, and applying a shock wave intensity of 0.8 W for the controlled shockwave operation at the next horizontal well perforation point; and applying, when the instantaneous gas production rate and the casing pressure show no change, a shock wave intensity of 1.2 W for the controlled shockwave operation at the next horizontal well perforation point.

13. The controlled shockwave-based stimulation method for the CBM horizontal well according to claim 12, wherein the stimulation method comprises: before conducting the controlled shockwave operation, notifying a surface well drainage constructor to continuously monitor the drainage parameter comprising flowing bottomhole pressure, casing pressure, and instantaneous gas production rate; and notifying an underground constructor in case of any abnormality.

* * * * *